US009062500B2

(12) United States Patent
Robinson et al.

(10) Patent No.: US 9,062,500 B2
(45) Date of Patent: Jun. 23, 2015

(54) SYSTEM AND METHOD TO FACILITATE INTERVENTIONS FROM AN OFFSHORE PLATFORM

(75) Inventors: Larry Robinson, Ampang (MY); Gary Simmons, Mardella (AU)

(73) Assignee: Schlumberger Technology Corporation, Sugar Land, TX (US)

( * ) Notice: Subject to any disclaimer, the term of this patent is extended or adjusted under 35 U.S.C. 154(b) by 1336 days.

(21) Appl. No.: 12/174,206

(22) Filed: Jul. 16, 2008

(65) Prior Publication Data

US 2009/0025937 A1 Jan. 29, 2009

Related U.S. Application Data

(60) Provisional application No. 60/951,007, filed on Jul. 20, 2007.

(51) Int. Cl.

| | |
|---|---|
| ***E21B 41/00*** | (2006.01) |
| ***E21B 15/00*** | (2006.01) |
| ***E21B 15/02*** | (2006.01) |
| ***E21B 19/22*** | (2006.01) |

(52) U.S. Cl.

CPC ..... *E21B 15/003* (2013.01); *E21B 15/02* (2013.01); *E21B 19/22* (2013.01)

(58) Field of Classification Search

CPC ..... E21B 15/003; E21B 15/02; E21B 19/22
USPC ..... 166/341, 342, 343, 366, 350–355, 78.1; 405/196, 158, 195.1, 201; 248/178.1, 248/177.1; 212/282, 283, 307, 223, 251
See application file for complete search history.

(56) References Cited

U.S. PATENT DOCUMENTS

| | | | | |
|---|---|---|---|---|
| 4,068,487 | A * | 1/1978 | Pease et al. | 405/201 |
| 4,208,158 | A * | 6/1980 | Davies et al. | 414/22.68 |
| 5,704,427 | A * | 1/1998 | Buck et al. | 166/338 |
| 5,975,203 | A | 11/1999 | Payne et al. | |
| 5,975,805 | A | 11/1999 | Morvan et al. | |
| 6,076,046 | A | 6/2000 | Vasudevan et al. | |
| 6,276,454 | B1 * | 8/2001 | Fontana et al. | 166/343 |
| 6,705,398 | B2 | 3/2004 | Weng | |
| 6,763,889 | B2 | 7/2004 | Rytlewski et al. | |
| 6,763,890 | B2 | 7/2004 | Polsky et al. | |
| 6,920,936 | B2 | 7/2005 | Sheiretov et al. | |
| 6,923,253 | B2 | 8/2005 | Saheta et al. | |
| 6,997,258 | B2 | 2/2006 | Homan et al. | |
| 7,063,159 | B2 | 6/2006 | Patton et al. | |
| 7,073,592 | B2 | 7/2006 | Polsky et al. | |
| 7,264,057 | B2 | 9/2007 | Rytlewski et al. | |
| 7,334,642 | B2 | 2/2008 | Doering et al. | |
| 7,357,184 | B2 | 4/2008 | Patton et al. | |
| 7,404,443 | B2 | 7/2008 | Patton et al. | |
| 7,527,100 | B2 * | 5/2009 | Abadie | 166/298 |
| 2002/0074125 | A1 * | 6/2002 | Fikes et al. | 166/352 |
| 2009/0151955 | A1 * | 6/2009 | Bamford et al. | 166/335 |
| 2010/0314121 | A1 * | 12/2010 | Sorenson et al. | 166/342 |

* cited by examiner

*Primary Examiner* — James G Sayre
(74) *Attorney, Agent, or Firm* — Michael L. Flynn; Timothy Curington; Robin Nava

(57) ABSTRACT

A technique facilitates intervention operations in a plurality of wells from an offshore fixed platform. A jacking frame is movably mounted on the offshore fixed platform to provide access to selected wells of the plurality of wells. The jacking frame is coupled to a translation system that enables horizontal movement of the jacking frame along the offshore fixed platform to better position the jacking frame for intervention in desired wells. One or more jib cranes are mounted to the jacking frame to lift or deploy equipment with respect to selected wells.

21 Claims, 3 Drawing Sheets

SYSTEM AND METHOD TO FACILITATE INTERVENTIONS FROM AN OFFSHORE PLATFORM

CROSS-REFERENCE TO RELATED APPLICATION

The present document is based on and claims priority to U.S. Provisional Application Ser. No. 60/951,007, filed Jul. 20, 2007.

BACKGROUND

Oil producers use offshore platforms to support subsea oil wells. Typically, the offshore platforms have multiple oil and/or gas wells installed, and the remedial work has been done on a well by well basis. A barge system is commonly employed to enable the servicing of offshore platforms with small cranes. Because of the substantial overall cost of an intervention/servicing operation, several wells are normally serviced on the same platform. However, current servicing systems are designed for use on only one well at a time and do not provide mobility for rapid or combined intervention operations on multiple wells.

SUMMARY

In general, the present invention provides a system and methodology for facilitating intervention operations in a plurality of wells from an offshore fixed platform. A jacking frame is movably mounted on the offshore fixed platform to provide access to selected wells of the plurality of wells. The jacking frame is coupled to a translation system that enables horizontal movement of the jacking frame along the offshore fixed platform to better position the jacking frame for intervention in desired wells. One or more jib cranes, such as a pair of opposing jib cranes, are mounted to the jacking frame to lift or deploy equipment with respect to selected wells.

A system for facilitating multiple interventions in a plurality of wells includes a jacking frame mounted on an offshore fixed platform, a pair of opposing jib cranes mounted to the jacking frame, and a translation system to move the jacking frame laterally along the offshore fixed platform to facilitate access to the plurality of wells. Alternatively, the jacking frame and the pair of opposing jib cranes are movable to provide 360 degree access to the plurality of wells. Alternatively, the jacking frame comprises a vertical adjustment mechanism. Alternatively, the vertical adjustment mechanism comprises hydraulic cylinders. Alternatively, the translation system comprises modular rails along which the jacking frame is able to move. Alternatively, the translation system comprises a winch to move the jacking frame in a first horizontal direction. Alternatively, the translation system comprises a hydraulic cylinder system to move the jacking frame in a second horizontal direction. Alternatively, the winch comprises a hydraulic winch. Alternatively, the system further comprises coiled tubing injection equipment mounted on the jacking frame. Alternatively, the system further comprises a jib crane winch to enable lifting and placement of equipment into selected wells of the plurality of wells.

In another embodiment, the present invention provides a method of treating a plurality of wells, comprising mounting a jacking frame to an offshore platform for movement along the platform, moving the jacking frame horizontally along the platform to provide access to specific wells of a plurality of wells, and delivering equipment into or out of selected wells with a jib crane mounted to the jacking frame for movement with the jacking frame. Alternatively, the mounting comprises mounting the jacking frame to modular rails that can be assembled according to the configuration of the platform. Alternatively, the moving comprises moving the jacking frame in a front-to-back direction and a side-to-side direction. Alternatively, moving comprises moving the jacking frame in a first horizontal direction with a winch. Alternatively, moving comprises moving the jacking frame in a second horizontal direction with a hydraulic system. Alternatively, the method further comprises adjusting the jacking frame in a vertical direction. Alternatively, the method further comprises mounting a pair of opposed jib cranes on the jacking frame. Alternatively, delivering comprises rotating the jib crane and moving comprises translating the jacking frame to facilitate access to the specific wells.

In another embodiment the present invention provides a system, comprising a jacking frame mounted on an offshore fixed platform, a translation system coupled to the jacking frame to selectively move the jacking frame horizontally toward selected wells, a height adjustment mechanism to enable selective adjustment of the height of the jacking frame, an injector mounted on the jacking frame to inject coiled tubing, and a jib crane mounted on the jacking frame to deliver equipment to selected wells. Alternatively, the translation system comprises a plurality of modular rails. Alternatively, the translation system comprises a first mechanism oriented to cause movement in a first horizontal direction and a second mechanism oriented to cause movement in a second horizontal direction. Alternatively, the jib crane is pivotable. Alternatively, the jib crane comprises a pair of opposed jib cranes.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for facilitating service operations, e.g. intervention operations, from an offshore fixed platform. The system and methodology enable a producer, e.g. an oil producer or gas producer, to access wells that were previously not accessible. As a result, the producer is better able to plan and implement a complete platform intervention on a plurality of wells associated with a particular offshore fixed platform. The system and method further facilitate quick movement from one well to another which improves the speed at which the equipment can be installed even in wells that are not in a traditional work path, thus reducing operation time and costs.

Furthermore, the system can be constructed as a modular system that enables adaptation to many types of platforms having various sizes and configurations. Thus, in addition to facilitating the performance of intervention operations on multiple wells arranged in various positions or patterns, the system is readily used with many types of new or existing platforms. Also, the mobility of the system enables performance of work on multiple wells associated with a given platform such that operations can be conducted in wells concurrently or in rapid succession.

Figure 1:
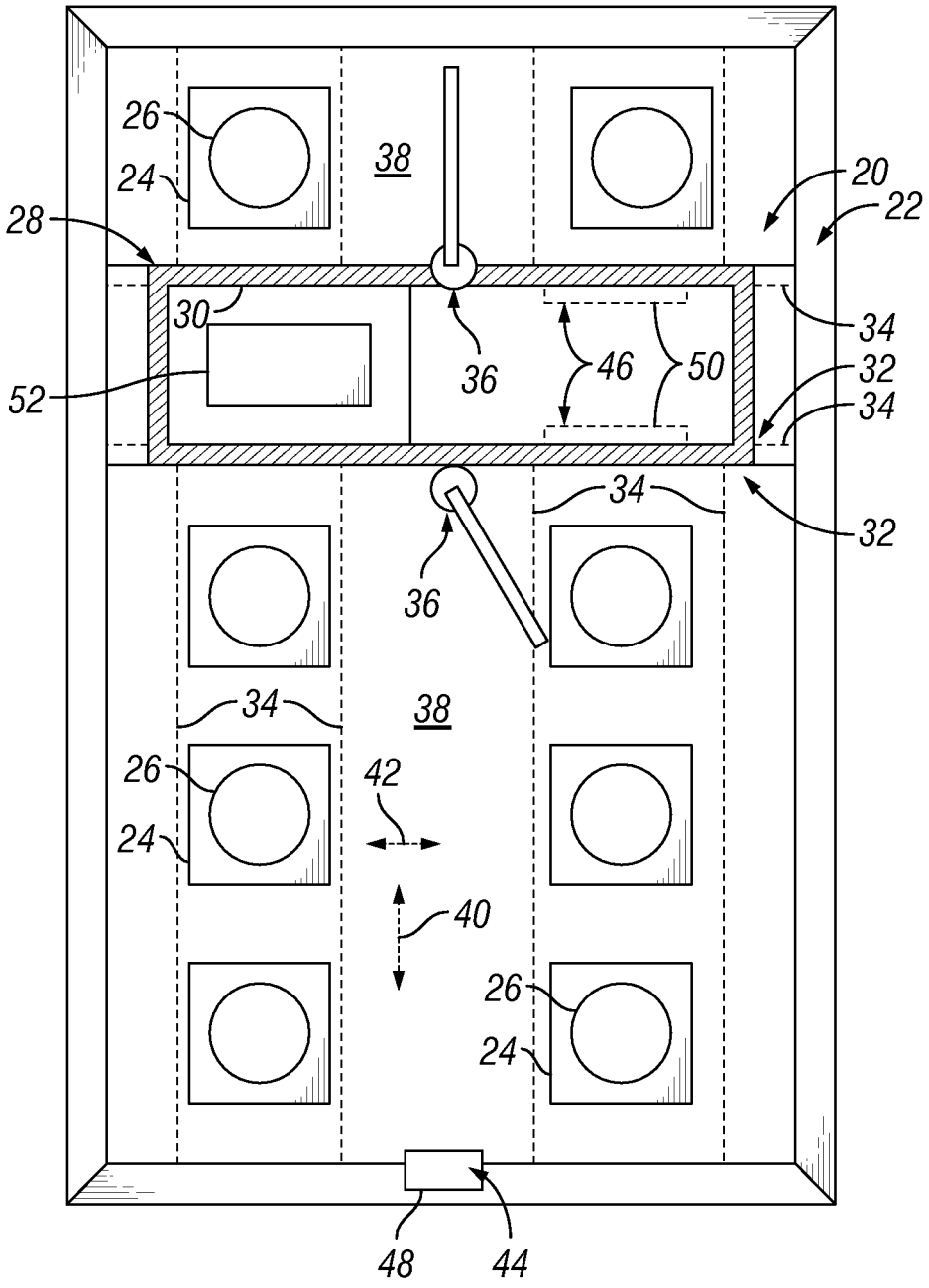
FIG. 1 is a schematic plan view of a service/intervention system deployed on an offshore fixed platform, according to an embodiment of the present invention.

Referring generally to FIG. 1, one embodiment of a system 20 is illustrated as mounted on an offshore fixed platform 22. The offshore fixed platform 22 is associated with a plurality of wells 24 having wellbores 26. The system 20 enables performance of a variety of intervention operations on some or all of the wells 24. In this embodiment, system 20 comprises a jacking frame 28 having a jacking frame carriage 30 that enables lateral movement along offshore fixed platform 22. The lateral movement is facilitated by a translation system 32 to which jacking frame carriage 30 is connected. By way of example, translation system 32 may comprise a plurality of tracks or rails 34 along which jacking frame carriage 30 can be moved. In FIG. 1, rails 34 are modular rails represented by dashed lines. The modular rails 34 can be assembled with modular rail pieces that allow the rails 34 and translation system 32 to be adapted to numerous offshore platforms 22 having various sizes and configurations.

System 20 also may comprise at least one jib crane 36 mounted on jacking frame 28. As illustrated, system 20 comprises a pair of opposed jib cranes 36 pivotably mounted to jacking frame 28 on opposite sides of the jacking frame 28. The pair of opposed jib cranes 36 are positioned for pivoting movement between selected wells 24 and generally extend into well bays 38 on opposite sides of jacking frame 28.

In addition to the pivoting motion of jib cranes 36, jacking frame 28 can be moved laterally in a first horizontal direction, represented by arrow 40, and laterally in a second horizontal direction, represented by arrow 42. The first horizontal direction 40 can be referred to as a side-to-side direction, and the second horizontal direction 42 can be referred to as a front-to-back direction. Lateral movement of the jacking frame 28 can be achieved by, for example, a first mechanism 44 and a second mechanism 46. By way of example, first mechanism 44 comprises at least one carriage winch 48, e.g. a hydraulic winch, coupled to jacking frame carriage 30, and second mechanism 46 may comprise a hydraulic actuator, such as hydraulic cylinders 50 mounted between jacking frame carriage 30 and offshore fixed platform 22. Movement of jacking frame carriage 30 and jacking frame 28 can be achieved in the side-to-side direction and the front-to-back direction simply by actuating first mechanism 44 and/or second mechanism 46 as desired to move jacking frame 28 along rails 34 via jacking frame carriage 30. The movement may be continued until the jacking frame 28 is properly positioned proximate specific wells 24 selected to undergo an intervention operation. Alternatively, the horizontal direction in which the jacking frame 28 can be moved is in a diagonal direction (i.e. at an angle to the directions 40 and 42) while remaining within the scope of the present invention, as will be appreciated by those skilled in the art.

In many applications, system 20 also comprises coiled tubing injection equipment 52 used for deploying and withdrawing coiled tubing from selected wells 24. Because of the size and weight of the components that can be incorporated into system 20, the rails 34 can be attached to load bearing members of the offshore fixed platform 22. For example, many offshore platforms are constructed with load bearing I-beams onto which rails 34 can be mounted for supporting the loads that result from system 20 and the intervention operations performed in wells 24.

Figure 2:
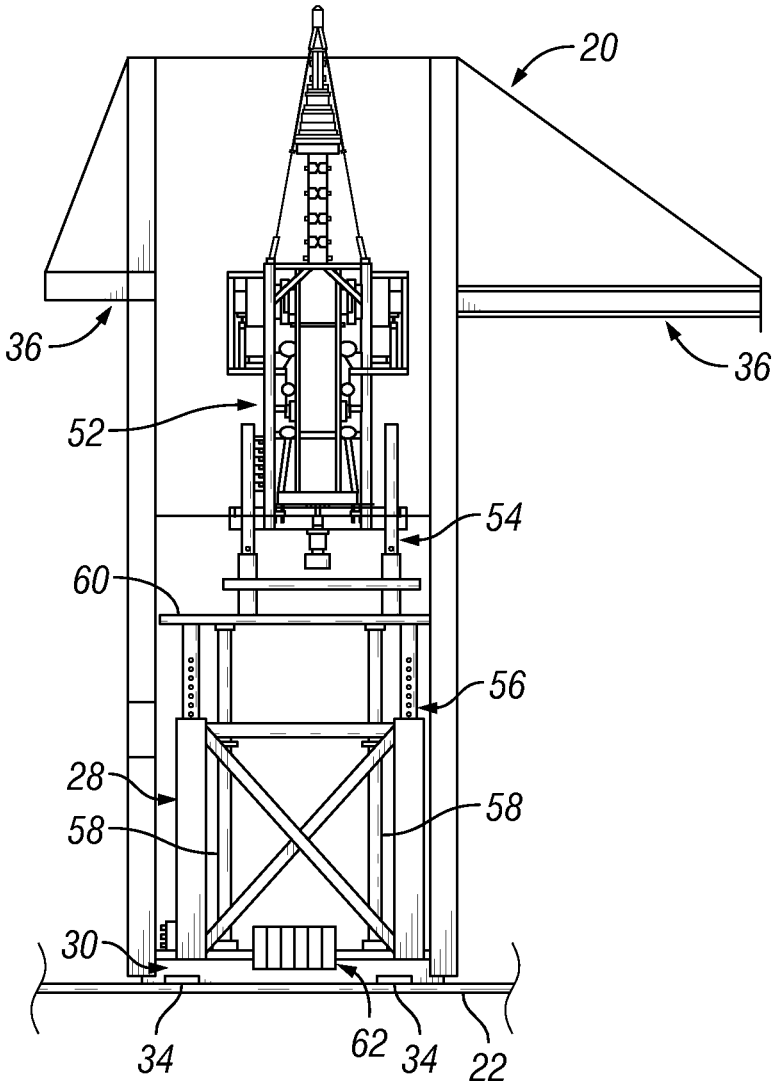
FIG. 2 is a front view of a service/intervention system deployed on an offshore fixed platform for performing intervention operations with respect to a plurality of wells, according to an embodiment of the present invention.
Figure 3:
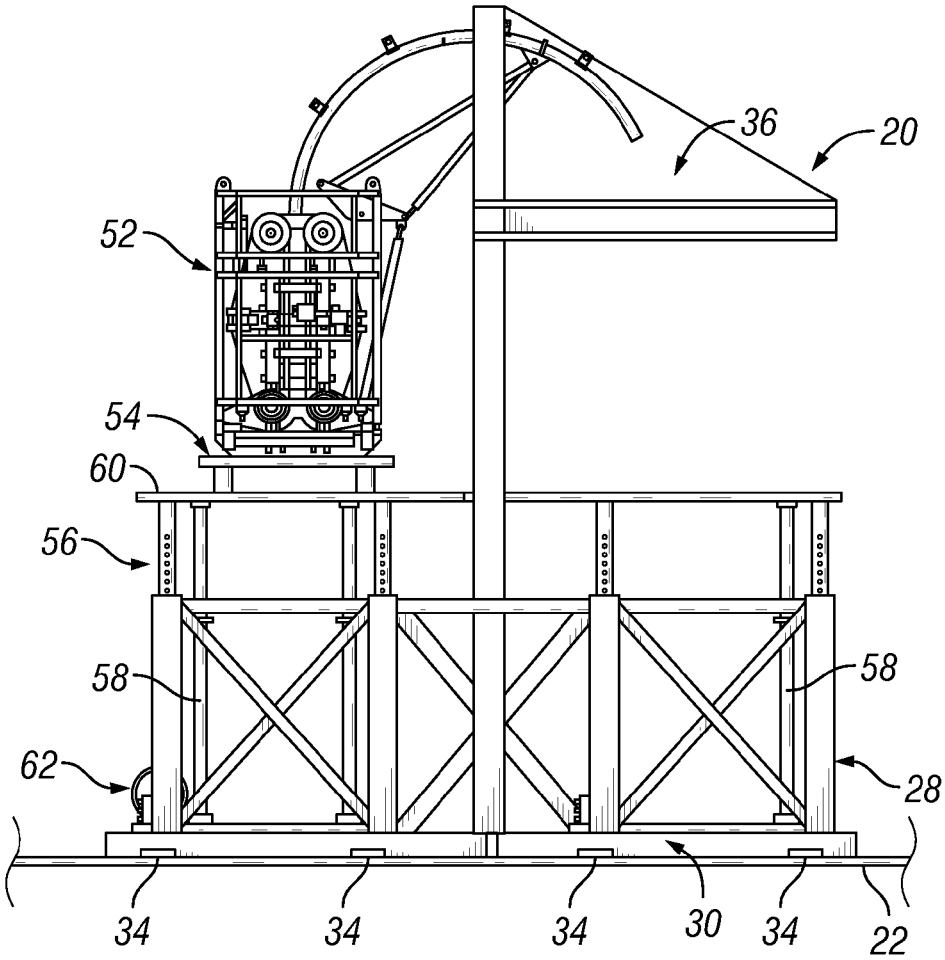
FIG. 3 is a side view of the system illustrated in FIG. 2, according to an embodiment of the present invention.
Figure 4:
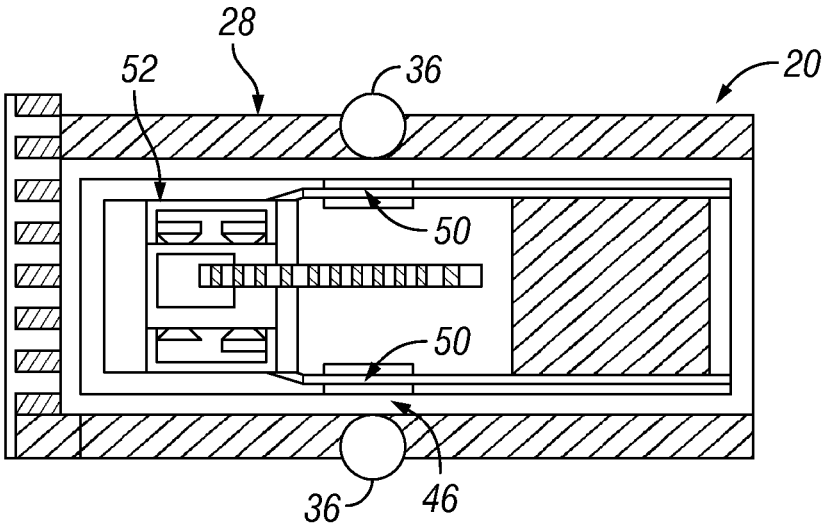
FIG. 4 is a top view of the system illustrated in FIG. 3, according to an embodiment of the present invention.

Referring generally to FIGS. 2-4, one embodiment of system 20 is illustrated in greater detail. In this embodiment, coiled tubing injection equipment 52 is mounted on a rotating injector table 54, as best illustrated in FIGS. 2 and 3. The rotating injector table 54 provides added versatility with respect to delivering and withdrawing coiled tubing from selected wells 24. Additionally, jacking frame 28 may comprise a vertical adjustment mechanism 56 that can be operated to enable selective adjustment of the height at which coiled tubing injection equipment 52 is positioned above the offshore platform 22. By way of example, the vertical adjustment mechanism may comprise a hydraulic system that utilizes hydraulic cylinders 58 to raise and lower a mounting platform 60 of jacking frame 28.

The system 20 also may comprise one or more jib crane winches 62 that can be used with one or both of the jib cranes 36. The one or more jib crane winches 62 can be employed when the jib cranes 36 are used to pick up or lower heavy tools. In a variety of intervention procedures, the jib cranes 36 are used to pick up or lower tool strings, a variety of intervention tools, lubricators, blowout prevention equipment, and other intervention related equipment. The jib cranes 36 can be employed to move heavy tools, and can swivel through a substantial range of motion, e.g. 200 degrees. In the embodiment illustrated, the jib cranes also are mounted generally at the center point of the jacking frame 28 to provide 180 degree access to well bays on either side of the jacking frame 28. Accordingly, the movement of jacking frame 28 and jib cranes 36 provides 360 degree access to the plurality of wells 24.

Use of system 20 enables an operator to plan a platform intervention in which several wells 24 have ongoing work at the same time. The system also facilitates rapid sequential movement from one well 24 to the next. Separate jacking frame components allow for small crane loads and can be preassembled via a work boat and platform crane. The center point jib cranes 36 allow use of deployed tool systems that are longer than those otherwise used in conventional systems.

In the example illustrated in FIGS. 2-4, the rails 34 can be assembled in a rectangular, e.g. square, pattern on the top of the platform jacket for movement via carriage winch 48 and hydraulic actuator 46 (see FIG. 4). The rails 34 allow jacking frame carriage 30 and jacking frame 28 to be moved across the entire offshore fixed platform 22 by carriage winch 48. The hydraulic rams 50 can be selectively actuated to position the carriage 30 and jacking frame 28 from front-to-back relative to the platform. Movement of carriage 30 and jacking frame 28 enable the coiled tubing injection equipment 52 to be positioned over the top of any of the platform wells 24. Furthermore, the tracking/rails 34 can be mounted directly to the structure of platform 22 which mitigates potential deck loading problems.

The three-axis movement of jacking frame 28 and equipment 52 in the vertical, horizontal lengthwise, and horizontal crosswise (or horizontal diagonal) directions enables great speed and flexibility in servicing multiple wells. Additionally, the use of a jib crane, such as the opposed pair of jib cranes 36, also provides great reach and flexibility for moving equipment into or out of selected wells. The mobility of the jacking frame and jib cranes facilitates the performance of various servicing operations on a plurality of wells during the same time period or in rapid succession.

Well system 20 can be constructed in a variety of configurations for use in many environments and applications. Additionally, the size and arrangement of the components can be adjusted according to the environment and according to well layout and servicing procedures to be conducted. A variety of equipment types can be mounted on jacking frame 28, and various devices can be employed to impart motion to the jacking frame relative to offshore fixed platform 22. Additionally, the modularity of the rail system enables adjustment of the path along which the jacking frame moves and also facilitates adaptation to a variety of platform sizes and configurations. The structure of the system components, e.g. jacking frame 28, carriage 30, rails 34, equipment 52, and other components can be selected according to the anticipated service operation parameters.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for facilitating multiple interventions in a plurality of wells, comprising:

a jacking frame mounted on an offshore fixed platform associated with the plurality of wells;

a vertical adjustment mechanism coupled to the jacking frame for vertically adjusting at least a portion of the jacking frame to vertically position well equipment above the wells for an intervention operation in the wells;

a pair of opposing jib cranes mounted to the jacking frame; and a translation system comprising rails modularly coupled to the offshore platform and to the jacking frame to move the jacking frame laterally along the offshore fixed platform to facilitate access to the plurality of wells, the rails adaptively coupled to the platform in a configuration to enable multiple interventions in the plurality of wells.

2. The system as recited in claim 1, wherein the jacking frame and the pair of opposing jib cranes are movable to provide 360 degree access to the plurality of wells.

3. The system as recited in claim 1, wherein the vertical adjustment mechanism comprises hydraulic cylinders.

4. The system as recited in claim 1, wherein the translation system comprises a winch to move the jacking frame in a first horizontal direction.

5. The system as recited in claim 4, wherein the translation system comprises a hydraulic cylinder system to move the jacking frame in a second horizontal direction.

6. The system as recited in claim 4, wherein the winch comprises a hydraulic winch.

7. The system as recited in claim 1, further comprising coiled tubing injection equipment mounted on the jacking frame.

8. The system as recited in claim 1, further comprising a jib crane winch to enable lifting and placement of equipment into selected wells of the plurality of wells.

9. The system as recited in claim 1, wherein an injector is rotatably mounted to the jacking frame via a rotating injector table.

10. A method of treating a plurality of wells, comprising:

assembling a plurality of modular rails to form a translation system on an offshore platform associated with the plurality of wells, the rails adaptively assembled according to a configuration of the platform and the plurality of wells;

mounting a jacking frame to the translation system for movement along the platform;

moving the jacking frame horizontally along the platform to provide access to specific wells of a plurality of wells by moving the jacking frame in a first horizontal direction with a winch and by moving the jacking frame in a second horizontal direction with a hydraulic system;

adjusting at least a portion of the jacking frame in a vertical direction to position equipment vertically with respect to the wells; and delivering the equipment into or out of selected wells with a jib crane mounted to the jacking frame for movement with the jacking frame.

11. The method as recited in claim 10, wherein moving comprises moving the jacking frame in a front-to-back direction and a side-to-side direction.

12. The method as recited in claim 10, further comprising mounting a pair of opposed jib cranes on the jacking frame.

13. The method as recited in claim 12, wherein delivering comprises rotating the jib crane and moving comprises translating the jacking frame to facilitate access to the specific wells.

14. The system as recited in claim 10, wherein an injector is rotatably mounted to the jacking frame via a rotating injector table.

15. The method according to claim 10 wherein delivering comprises delivering coiled tubing equipment into or out of the wells, the coiled tubing equipment further comprising an injector mounted to the jacking frame on a rotating injector table.

16. The method according to claim 10 further comprising adjusting the rails to adjust the path on which the jacking frame moves.

17. A system, comprising:

a jacking frame mounted on an offshore fixed platform associated with a plurality of wells, the jacking frame comprising at least one mounting platform;

a translation system coupled to the jacking frame to selectively move the jacking frame horizontally toward selected wells;

an injector rotatably mounted on the mounting platform to inject coiled tubing into and out of the wells;

a height adjustment mechanism to enable selective adjustment of the height of the injector with respect to the wells; and a jib crane mounted on the jacking frame to deliver equipment to selected wells.

18. The system as recited in claim 17, wherein the translation system comprises a plurality of modular rails.

19. The system as recited in claim 18, wherein the translation system comprises a first mechanism oriented to cause movement in a first horizontal direction and a second mechanism oriented to cause movement in a second horizontal direction.

20. The system as recited in claim 17, wherein the jib crane is pivotable.

21. The system as recited in claim 17, wherein the jib crane comprises a pair of opposed jib cranes.

* * * * *